US011499112B2

(12) United States Patent
Aoki et al.

(10) Patent No.: US 11,499,112 B2
(45) Date of Patent: Nov. 15, 2022

(54) HYDRAULIC OIL COMPOSITION

(71) Applicant: IDEMITSU KOSAN CO., LTD., Chiyoda-ku (JP)

(72) Inventors: Shinji Aoki, Sodegaura (JP); Shota Inoue, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/633,197

(22) PCT Filed: Sep. 27, 2018

(86) PCT No.: PCT/JP2018/036009
§ 371 (c)(1),
(2) Date: Jan. 23, 2020

(87) PCT Pub. No.: WO2019/077961
PCT Pub. Date: Apr. 25, 2019

(65) Prior Publication Data

US 2021/0130727 A1 May 6, 2021

(30) Foreign Application Priority Data

Oct. 16, 2017 (JP) ..... JP2017-200656

(51) Int. Cl.

| | |
|---|---|
| ***C10M 133/12*** | (2006.01) |
| ***C10M 129/10*** | (2006.01) |
| ***C10M 133/44*** | (2006.01) |
| ***C10M 137/08*** | (2006.01) |
| ***C10M 141/06*** | (2006.01) |
| ***C10M 141/10*** | (2006.01) |
| ***C10M 169/04*** | (2006.01) |

(52) U.S. Cl.
CPC ..... *C10M 133/12* (2013.01); *C10M 129/10* (2013.01); *C10M 133/44* (2013.01); *C10M 137/08* (2013.01); *C10M 141/06* (2013.01); *C10M 141/10* (2013.01); *C10M 169/04* (2013.01)

(58) Field of Classification Search
CPC ..... C10M 133/12; C10M 169/04; C10M 129/10; C10M 137/08; C10M 141/10; C10M 133/44; C10M 141/06; C10M 2203/1025; C10M 2215/223; C10M 2223/045; C10M 2207/283; C10M 2209/084; C10M 2223/041; C10M 2223/043; C10M 2215/28; C10M 2215/064; C10M 2207/026; C10N 2040/04; C10N 2030/02; C10N 2040/08; C10N 2030/04; C10N 2030/06; C10N 2010/04
See application file for complete search history.

(56) References Cited

U.S. PATENT DOCUMENTS

| | | | | |
|---|---|---|---|---|
| 5,902,777 | A * | 5/1999 | Hashimoto | C10M 129/76 508/438 |
| 2007/0203035 | A1* | 8/2007 | Dong | C10M 141/08 508/485 |
| 2007/0293408 | A1* | 12/2007 | Opstal | C10M 169/04 508/471 |
| 2009/0186785 | A1 | 7/2009 | Kamimura | |
| 2010/0016195 | A1 | 1/2010 | Shirahama et al. | |
| 2010/0093578 | A1* | 4/2010 | Tsujimoto | C10M 167/00 508/430 |
| 2010/0160191 | A1 | 6/2010 | Butke et al. | |
| 2015/0232780 | A1* | 8/2015 | Shrestha | C10M 129/08 508/370 |

(Continued)

FOREIGN PATENT DOCUMENTS

| | | | |
|---|---|---|---|
| CN | 1166180 | A | 11/1997 |
| CN | 2004-35624 | A | 2/2004 |

(Continued)

OTHER PUBLICATIONS

International Search Report dated Nov. 27, 2018 in PCT/JP2018/036009 filed on Sep. 27, 2018, citing documents AA-AD and AK-AS therein, 3 pages.
Office Action dated Aug. 10, 2021 in corresponding Indian Patent Application No. 202047003735 (with English Translation), 7 pages.
Extended European Search Report dated Jun. 1, 2021 in European Patent Application No. 18868808.9, citing documents AO through AQ therein, 7 pages.
Office Action dated Nov. 16, 2021, in Chinese Patent Application No. 201880048964.X filed Sep. 27, 2018, citing documents AB and AO-AS.

(Continued)

*Primary Examiner* — Pamela H Weiss
(74) *Attorney, Agent, or Firm* — Oblon, McClelland, Maier & Neustadt, L.L.P.

(57) ABSTRACT

The present invention relates to a hydraulic fluid composition containing a base oil (A), an antioxidant (B) including an amine-based antioxidant (B1) and a phenol-based antioxidant (B2), and a succinimide-based compound (C), wherein the hydraulic fluid composition satisfies the following requirement (I); and is to be used for hydraulic equipment which is equipped with at least one of a wet type brake and a wet type clutch and which is selected from a construction machinery, a general industrial machinery, and a power generator, and in which a working pressure is 30 MPa or more. The hydraulic fluid composition is not only excellent in wear resistance and an effect for suppressing the sludge formation but also excellent in a braking performance or a clutch performance, even when used under a high-pressure condition.
Requirement (I): A static friction coefficient ($\mu_s$) after 1,000 cycles, as measured in conformity with the SAE No. 2 test described in JCMAS P 047:2004, is 0.100 to 0.162.

14 Claims, No Drawings

(56) References Cited

U.S. PATENT DOCUMENTS

| | | | | |
|---|---|---|---|---|
| 2016/0032214 | A1* | 2/2016 | Shinoda | C10M 161/00 508/437 |
| 2016/0281020 | A1* | 9/2016 | Yamamoto | C10M 141/10 |
| 2016/0281022 | A1* | 9/2016 | Yamamoto | C10M 141/10 |
| 2017/0298287 | A1 | 10/2017 | Tamura | |

FOREIGN PATENT DOCUMENTS

| | | | | |
|---|---|---|---|---|
| CN | 101517054 | A | | 8/2009 |
| CN | 105164238 | A | | 12/2015 |
| CN | 107075405 | A | | 8/2017 |
| EP | 0 867 498 | A1 | | 9/1998 |
| EP | 3 572 485 | A1 | | 11/2019 |
| JP | 52-69408 | | | 6/1977 |
| JP | 2-265998 | A | | 10/1990 |
| JP | 7-179875 | A | | 7/1995 |
| JP | 9-111277 | A | | 4/1997 |
| JP | H10-265793 | | | 10/1998 |
| JP | 11-323365 | A | | 11/1999 |
| JP | 11323365 | A | * | 11/1999 |
| JP | 2000-265188 | A | | 9/2000 |
| JP | 2000265188 | A | * | 9/2000 |
| JP | 2003-171684 | A | | 6/2003 |
| JP | 2007-161773 | A | | 6/2007 |
| JP | 2009242677 | A | * | 10/2009 |
| JP | 2010-502788 | A | | 1/2010 |
| JP | 5269408 | B2 | * | 8/2013 |
| JP | 5503066 | B2 | | 5/2014 |
| JP | 5503066 | B2 | * | 5/2014 |
| JP | 2015-25115 | A | | 2/2015 |
| WO | WO 2014/156338 | A1 | | 10/2014 |

OTHER PUBLICATIONS

Office Action dated Sep. 7, 2021, in Japanese Patent Application No. 2017-200856 filed Oct. 16, 2017 (with English transiation), citing document AO.

Chinese Office Action dated Apr. 13, 2022, in corresponding Chinese Patent Application No. 201880048964.X (with English Translation), 21 pages.

Office Action dated May 31, 2022, in corresponding Japanese Patent Application No. 2017-200656 (with English Translation), citing document AO therein, 8 pages.

Hearing Notice issued in Indian Patent Application No. 202047003735.

Office Action dated Sep. 5, 2022, in Chinese Patent Application No. 201880048964.X, filed Sep. 27, 2018.

* cited by examiner

HYDRAULIC OIL COMPOSITION

TECHNICAL FIELD

The present invention relates to a hydraulic fluid composition.

BACKGROUND ART

Hydraulic equipment to be mounted on a construction machinery, such as a hydraulic excavator, a crane, a wheel loader, and a bulldozer, is required to be operated at a high pressure, a high temperature, or a high speed, or under a high load.

For that reason, a hydraulic fluid composition which is used in the hydraulic equipment for construction machinery is demanded to have wear resistance or oxidation stability such that even when used at a high pressure, a high temperature, or a high speed, or under a high load over a long period of time, it does not impair performances of the hydraulic equipment.

In particular, a hydraulic fluid composition which is used for hydraulic equipment where a working pressure becomes 30 MPa or more is liable to promptly cause deterioration in oxidation stability or lubricating performance and is liable to generate a harmful effect, such as sludge formation and operation failure.

For example, PTL 1 discloses a hydraulic fluid composition in which an amine-based antioxidant, a phenol-based antioxidant, and a phosphate are contained in predetermined proportions in a polyolefin having a predetermined kinematic viscosity as a hydraulic fluid composition to be used for hydraulic equipment in which a working pressure is 30 MPa or more, such as a construction machinery.

In accordance with PTL 1, it is disclosed that the foregoing hydraulic fluid composition is excellent in oxidation stability and lubricating performance under a high pressure, effectively prevents early deterioration, sludge formation, or the like because of pressure elevation, and can be used over a long period of time.

CITATION LIST

Patent Literature

PTL 1: Japanese Patent No. 5503066

SUMMARY OF INVENTION

Technical Problem

Now, for example, there is a case where hydraulic equipment to be mounted on a construction machinery is equipped with a wet type brake or a wet type clutch, which is used for a traveling hydraulic motor, a slewing hydraulic motor, or the like. For lubricating such, it is general that the hydraulic fluid to be used for hydraulic equipment is also used.

For that reason, the hydraulic fluid to be used for the hydraulic equipment equipped with a wet type brake or a wet type clutch is required to have not only the aforementioned performance as a hydraulic fluid but also the lubricating performance of a wet type brake or a wet type clutch.

Namely, for the hydraulic fluid to be used for the construction machinery equipped with a wet type brake or a wet type clutch, a decrease of friction coefficient is demanded in order to secure smooth actions at the time of starting or just before stop of a hydraulic cylinder or the like.

Meanwhile, for the foregoing hydraulic fluid, the friction coefficient is also required to be appropriately high so as to not impair a braking performance or a clutch performance by the wet type brake and the wet type clutch.

In PTL 1, no investigation is made from the viewpoint of such braking performance or clutch performance.

An object of the present invention is to provide a hydraulic fluid composition which even when used under a high-pressure condition, is not only excellent in wear resistance and an effect for suppressing the sludge formation but also excellent in a braking performance or a clutch performance.

Solution to Problem

The present inventors have found that a hydraulic fluid composition containing a base oil, an antioxidant including an amine-based antioxidant and a phenol-based antioxidant, and a succinimide-based compound, the hydraulic fluid composition being prepared such that a static friction coefficient ($\mu_s$) by a specified test falls within a specified range, is able to solve the aforementioned problem, thereby leading to accomplishment of the present invention.

Specifically, the present invention provides the following [1].

[1] A hydraulic fluid composition containing a base oil (A), an antioxidant (B) including an amine-based antioxidant (B1) and a phenol-based antioxidant (B2), and a succinimide-based compound (C), wherein the hydraulic fluid composition satisfies the following requirement (I); and is to be used for hydraulic equipment which is equipped with at least one of a wet type brake and a wet type clutch and which is selected from a construction machinery, a general industrial machinery, and a power generator, and in which a working pressure is 30 MPa or more:

Requirement (I): A static friction coefficient ($\mu_s$) after 1,000 cycles, as measured in conformity with the SAE No. 2 test described in JCMAS P 047:2004, is from 0.100 to 0.162.

Advantageous Effects of Invention

The hydraulic fluid composition of the present invention is not only excellent in wear resistance and an effect for suppressing the sludge formation but also excellent in a braking performance or a clutch performance, even when used under a high-pressure condition.

DESCRIPTION OF EMBODIMENT

[Hydraulic Fluid Composition]

The hydraulic fluid composition of the present invention contains a base oil (A), an antioxidant (B) including an amine-based antioxidant (B1) and a phenol-based antioxidant (B2), and a succinimide-based compound (C).

The hydraulic fluid composition of one embodiment of the present invention preferably contains a phosphorus-based anti-wear agent (D), and it may contain other additive not corresponding to the components (B) to (D) within a range where the effects of the present invention are not impaired.

In the hydraulic fluid composition of one embodiment of the present invention, the total content of the component (A), the component (B), and the component (C) is preferably 60% by mass or more, more preferably 65% by mass or more, still more preferably 70% by mass or more, and yet still more preferably 75% by mass or more, and it is typically 100% by mass or less, preferably 99.0% by mass or less, and more preferably 98.0% by mass or less, on a basis of the total amount (100% by mass) of the hydraulic fluid composition.

In the hydraulic fluid composition of one embodiment of the present invention, the total content of the component (A), the component (B), the component (C), and the component (D) is preferably 60% by mass or more, more preferably 65% by mass or more, still more preferably 70% by mass or more, yet still more preferably 75% by mass or more, and even yet still more preferably 80% by mass or more, and it is typically 100% by mass or less, preferably 99.5% by mass or less, and more preferably 99.0% by mass or less, on a basis of the total amount (100% by mass) of the hydraulic fluid composition.

Now, the hydraulic fluid composition of the present invention is one to be used for hydraulic equipment which is equipped with at least one of a wet type brake and a wet type clutch and which is selected from a construction machinery, a general industrial machinery, and a power generator, and in which a working pressure is 30 MPa or more, and satisfies the following requirement (I):

Requirement (I): A static friction coefficient ($\mu_s$) after 1,000 cycles, as measured in conformity with the SAE No. 2 test described in JCMAS P 047:2004, is 0.100 to 0.162.

As mentioned above, the hydraulic fluid composition to be used for hydraulic equipment which is equipped with a wet type brake or a wet type clutch is required to have not only a performance as the hydraulic fluid but also a lubricating performance of a wet type brake or a wet type clutch in a construction machinery or the like.

Namely, the requirement (I) is a prescription for providing a hydraulic fluid composition which has not only a performance required as the hydraulic fluid but also an excellent braking performance or clutch performance by the wet type brake and the wet type clutch in a construction machinery or the like.

When the static friction coefficient ($\mu_s$) prescribed in the requirement (I) is less than 0.100, in particular, the braking performance or clutch performance is inferior in the construction machinery, and there is a concern about worsening in responsibility at the time of stop.

On the other hand, when the static friction coefficient ($\mu_s$) is more than 0.162, there is a concern about worsening of braking properties of a construction machinery or the like, resulting in a possibility of early wear of the wet clutch.

From the viewpoint of improving the braking performance or clutch performance, the static friction coefficient ($\mu_s$) prescribed in the requirement (I) in the hydraulic fluid composition of one embodiment of the present invention is preferably 0.105 or more, more preferably 0.110 or more, and still more preferably 0.115 or more, and from the viewpoint of making the braking properties favorable and preventing early wear, it is preferably 0.158 or less, more preferably 0.156 or less, and still more preferably 0.153 or less.

In the hydraulic fluid composition of the present invention, in view of the fact that not only it contains the antioxidant (B) including the amine-based antioxidant (B1) and the phenol-based antioxidant (B2) and the succinimide-based compound (C), but also the kind of the component (C) and the content of the component (C) are regulated, the static friction coefficient ($\mu_s$) is regulated so as to satisfy the requirement (I).

The value of the static friction coefficient ($\mu_s$) of the hydraulic fluid composition of the present invention varies with the base oil (A) or the kind or the content of other additive.

Namely, it may also be said that the requirement (I) which the hydraulic fluid composition of the present invention satisfies is a prescription regarding the kind or the content or the like of each of the components to be contained in the hydraulic fluid composition.

A specific regulation method for providing a hydraulic fluid composition satisfying the requirement (I) is one described below with respect to each of the components.

<Base Oil (A)>

The base oil (A) which is contained in the hydraulic fluid composition of the present invention may be a mineral oil, may be a synthetic oil, or may be a mixed oil of two or more selected from mineral oils and synthetic oils.

Examples of the mineral oil include atmospheric residues obtained through atmospheric distillation of crude oils, such as paraffin-based crude oils, intermediate-base crude oils, and naphthene-based crude oils; distillates obtained through reduced-pressure distillation of such atmospheric residues; mineral oils obtained by subjecting the distillates to one or more purification treatments, such as solvent deasphalting, solvent extraction, hydrocracking, solvent dewaxing, catalytic dewaxing, and hydrorefining; and mineral oils obtained by isomerizing a wax (GTL wax (Gas To Liquids WAX)) which is obtained through the Fischer-Tropsch method, etc.

These mineral oils may be used alone or may be used in combination of two or more thereof.

Of these, as the mineral oil which is used in one embodiment of the present invention, it is preferred to contain a mineral oil grouped in Group 2 or Group 3 in the base oil category by API (American Petroleum Institute) or a mineral oil obtained by isomerizing a GTL wax.

A paraffin content (% $C_P$) of the mineral oil which is used in one embodiment of the present invention is preferably 60 or more, more preferably 65 or more, and still more preferably 70 or more, and it is typically 95 or less.

A naphthene content (% $C_N$) of the foregoing mineral oil is preferably 40 or less, more preferably 35 or less, still more preferably 30 or less, yet still more preferably 20 or less, and even yet still more preferably 10 or less, and it is typically 5 or more.

An aromatic content (% $C_A$) of the foregoing mineral oil is preferably less than 1.0, more preferably less than 0.5, still more preferably less than 0.1, and yet still more preferably less than 0.01.

The values of the paraffin content (% $C_P$), the naphthene content (% $C_N$), and the aromatic content (% $C_A$) of the mineral oil mean proportions (percentages) of the paraffin content, the naphthene content, and the aromatic content, respectively as measured by the ring analysis of ASTM D-3238 (n-d-M method).

Examples of the synthetic oil include synthetic oils, such as poly-α-olefins, e.g., an α-olefin homopolymer and an α-olefin copolymer (for example, an α-olefin copolymer having 8 to 14 carbon atoms, e.g., an ethylene-α-olefin copolymer); isoparaffins; various esters, e.g., a polyol ester and a dibasic acid ester; various ethers, e.g., polyphenyl ether; polyalkylene glycols; alkylbenzenes; and alkylnaphthalenes.

Of these, as the synthetic oil which is used in one embodiment of the present invention, it is preferred to contain one or more synthetic oils selected from poly-α-olefins, various esters, and polyalkylene glycols.

A kinematic viscosity at 40° C. of the base oil (A) is preferably 10 to 150 $mm^2/s$, more preferably 12 to 120 $mm^2/s$, still more preferably 15 to 100 $mm^2/s$, and yet still more preferably 20 to 80 $mm^2/s$.

A viscosity index of the base oil (A) is preferably 80 or more, more preferably 90, still more preferably 100 or more, and yet still more preferably 110 or more.

In this specification, the "kinematic viscosity" and the "viscosity index" mean values as measured in conformity of JIS K2283.

In the case where the base oil (A) is a mixed oil composed of two or more mineral oils, it is preferred that the kinematic viscosity and the viscosity index of the mixed oil fall within the aforementioned ranges, respectively. Furthermore, weighted average values calculated from the kinematic viscosity or viscosity index of each of the mineral oils constituting the mixed oil and the content proportion of each of the mineral oils can also be considered as the aforementioned "values of kinematic viscosity and viscosity index of mixed oil".

In the hydraulic fluid composition of one embodiment of the present invention, the content of the base oil (A) is preferably 55% by mass or more, more preferably 60% by mass or more, still more preferably 65% by mass or more, yet still more preferably 70% by mass or more, and especially preferably 75% by mass or more, and it is preferably 99.0% by mass or less, more preferably 98.5 by mass or less, and still more preferably 98.0% by mass or less, on a basis of the total amount (100% by mass) of the hydraulic fluid composition.

<Antioxidant (B)>

The antioxidant (B) which is contained in the hydraulic fluid composition of the present invention includes the amine-based antioxidant (B1) and the phenol-based antioxidant (B2).

By using a combination of the amine-based antioxidant (B1) and the phenol-based antioxidant (B2) as the antioxidant (B), when used for hydraulic equipment in which a working pressure is 30 MPa or more, a hydraulic fluid composition with a high effect for suppressing the sludge formation can be provided. In addition, it becomes easy to regulate the static friction coefficient (is) to the range prescribed in the requirement (I) through a combination with the component (C).

The amine-based antioxidant (B1) is preferably an aromatic amine compound, and more preferably at least one selected from a diphenylamine compound and a naphthylamine-based compound.

Examples of the diphenylamine-based compound include monoalkyldiphenylamine-based compounds having one alkyl group having 1 to 30 carbon atoms (preferably 4 to 30 carbon atoms, and more preferably 8 to 30 carbon atoms), such as monooctyldiphenylamine and monononyldiphenylamine; dialkyldiphenylamine compounds having two alkyl groups having 1 to 30 carbon atoms (preferably 4 to 30 carbon atoms, and more preferably 8 to 30 carbon atoms), such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkykliphenylamine-based compounds having three or more alkyl groups having 1 to 30 carbon atoms (preferably 4 to 30 carbon atoms, and more preferably 8 to 30 carbon atoms), such as tetrabutyldiphenylamine, tetrahexyldiphenylamine, tetraoctyldiphenylamine, and tetranonyldiphenylamine; and 4,4'-bis(α,α-dimethylbenzyl)diphenylamine.

Examples of the naphthylamine-based compound include phenyl-1-naphthylamine, butylphenyl-1-naphthylamine, pentylphenyl-1-naphthylamine, hexylphenyl-1-naphthylamine, heptylphenyl-1-naphthylamine, octylphenyl-1-naphthylamine, nonylphenyl-1-naphthylamine, decylphenyl-1-naphthylamine, and dodecylphenyl-1-naphthylamine.

Examples of the phenol-based antioxidant (B2) include monophenol-based antioxidants, such as 2,6-di-t-butylphenol, 2,6-di-t-butyl-4-methylphenol, 2,6-di-t-butyl-4-ethylphenol, isooctyl-3-(3,5-di-t-butyl-4-hydroxyphenyl)propionate, and octadecyl-3-(3,5-di-t-butyl-4-hydroxyphenyl) propionate; diphenol-based antioxidants, such as 4,4'-methylenebis(2,6-di-t-butylphenol) and 2,2'-methylenebis (4-ethyl-6-t-butylphenol); and hindered phenol-based antioxidants.

In one embodiment of the present invention, in order to provide a hydraulic fluid composition that when used for hydraulic equipment in which a working pressure is 30 MPa or more, not only has a high effect for suppressing the sludge formation but also satisfies the requirement (I), a content ratio of the component (B1) to the component (B2) [(B1)/(B2)] is preferably 1/6 or more and less than 1/2, more preferably 1/5 or more and 1/2.3 or less, and still more preferably 1/4 or more and 1/2.5 or less in terms of a mass ratio.

In the hydraulic fluid composition of one embodiment of the present invention, from the aforementioned viewpoint, the content of the component (B1) is preferably 0.01 to 1.0% by mass, more preferably 0.05 to 0.85% by mass, still more preferably 0.10 to 0.60% by mass, and yet still more preferably 0.19 to 0.45% by mass on a basis of the total amount (100% by mass) of the hydraulic fluid composition.

In the hydraulic fluid composition of one embodiment of the present invention, from the aforementioned viewpoint, the content of the component (B2) is preferably 0.025 to 6.0% by mass, more preferably 0.10 to 5.0% by mass, still more preferably 0.20 to 4.0% by mass, and yet still more preferably 0.40 to 2.0% by mass on a basis of the total amount (100% by mass) of the hydraulic fluid composition.

Although the antioxidant (B) which is used in one embodiment of the present invention may contain other antioxidant than the components (B1) and (B2), from the aforementioned viewpoint, it is preferred that its content is as small as possible.

Specifically, the total content of the components (B1) and (B2) is preferably 70 to 100% by mass, more preferably 80 to 100% by mass, still more preferably 90 to 100% by mass, and yet still more preferably 95 to 100% by mass on a basis of the total amount (100% by mass) of the component (B) contained in the hydraulic fluid composition.

In the hydraulic fluid composition of one embodiment of the present invention, from the aforementioned viewpoint, the content of the component (B) is preferably 0.035 to 7.0% by mass, more preferably 0.15 to 6.0% by mass, still more preferably 0.30 to 5.0% by mass, and yet still more preferably 0.59 to 3.0% by mass on a basis of the total amount (100% by mass) of the hydraulic fluid composition.

<Succinimide-Based Compound (C)>

The hydraulic fluid composition of the present invention contains the succinimide-based compound (C).

The hydraulic fluid composition of the present invention is prepared so as to satisfy the requirement (I) by containing the succinimide-based compound (C) together with the antioxidant (B) including the amine-based antioxidant (B1) and the phenol-based antioxidant (B2).

The succinimide-based compound (C) which is used in one embodiment of the present invention is preferably at least one selected from an alkenylsuccinimide (C1) and a boronated alkenylsuccinimide (C2), and more preferably, it contains at least the alkenylsuccinimide (C1).

Examples of the alkenylsuccinimide (C1) include an alkenylsuccinic acid monoimide represented by the following general formula (c-1) and an alkenylsuccinic acid bisimide represented by the following general formula (c-2).

(c-1)

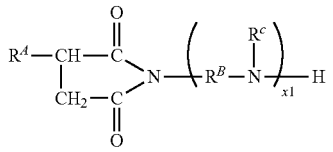

(c-2)

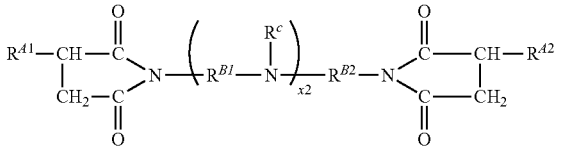

In the general formulae (c-1) and (c-2), $R^A$, $R^{A1}$, and $R^{A2}$ are each independently an alkenyl group having a weight average molecular weight (Mw) of 500 to 3,000 (preferably 700 to 3,000, and more preferably 1,000 to 2,500).

$R^B$, $R^{B1}$, and $R^{B2}$ are each independently an alkylene group having 2 to 5 carbon atoms.

$R^c$ is a hydrogen atom, an alkyl group having 1 to 10 carbon atoms, or a group represented by $-(AO)_n—H$ (wherein A represents an alkylene group having 2 to 4 carbon atoms, and n represents an integer of 1 to 10).

x1 is an integer of 1 to 10, preferably an integer of 2 to 5, and more preferably 3 or 4.

x2 is an integer of 0 to 10, preferably an integer of 1 to 4, and more preferably 2 or 3.

Examples of the alkenyl group which can be selected for $R^A$, $R^{A1}$, and $R^{A2}$ include a polybutenyl group, a polyisobutenyl group, and an ethylene-propylene copolymer. Of these, a polybutenyl group or a polyisobutenyl group is preferred.

Examples of the boronated alkenylsuccinimide (C2) include boron-modified products of the alkenylsuccinimide represented by the general formula (c-1) or (c-2).

A ratio of the boron atom and the nitrogen atom constituting the boronated alkenylsuccinimide (C2) [B/N] is preferably 0.01 to 0.6, more preferably 0.05 to 0.5, and still more preferably 0.1 to 0.4.

In the hydraulic fluid composition of one embodiment of the present invention, from the viewpoint of providing a hydraulic fluid composition satisfying the requirement (I), the content proportion of the component (C) is preferably 1.0 to 20.0 parts by mass, more preferably 5.0 to 18.0 parts by mass, and still more preferably 12.0 to 17.0 parts by mass on a basis of the total amount of 100 parts by mass of the components (B1) and (B2).

In the hydraulic fluid composition of one embodiment of the present invention, from the viewpoint of providing a hydraulic fluid composition satisfying the requirement (I), the content of the component (C) is preferably 0.01 to 1.0% by mass, more preferably 0.07 to 0.90% by mass, still more preferably 0.09 to 0.80% by mass, and yet still more preferably 0.10 to 0.60% by mass on a basis of the total amount (100% by mass) of the hydraulic fluid composition.

From the aforementioned viewpoint, the content of the component (C) as expressed in terms of a nitrogen atom is preferably 1 to 120 ppm by mass, more preferably 5 to 100 ppm by mass, still more preferably 7 to 90 ppm by mass, and yet still more preferably 10 to 70 ppm by mass on a basis of the total amount (100% by mass) of the hydraulic fluid composition.

In this specification, the content of the nitrogen atom means a value as measured in conformity with JIS K2609.

In the hydraulic fluid composition of one embodiment of the present invention, in the case of containing the boronated alkenylsuccinimide (C2) as the component (C), the content of the component (C) as expressed in terms of a boron atom is preferably 1 to 300 ppm by mass, more preferably 3 to 200 ppm by mass, and still more preferably 5 to 100 ppm by mass on a basis of the total amount (100% by mass) of the hydraulic fluid composition.

In this specification, the content of the boron atom means a value as measured in conformity with JPI-5S-38-03.

The hydraulic fluid composition of one embodiment of the present invention may further contain other ashless dispersant not corresponding to the component (C) within a range where the effects of the present invention are not impaired.

Examples of such other ashless dispersant include a benzylamine, a boron-containing benzylamine, a succinic acid ester, and a monovalent or divalent carboxylic acid amide represented by a fatty acid or succinic acid.

However, in the hydraulic fluid composition of one embodiment of the present invention, from the viewpoint of providing a hydraulic fluid composition satisfying the requirement (I), it is preferred that the content of the other ashless dispersant not corresponding to the component (C) is as small as possible.

Specifically, the content of the foregoing ashless dispersant is preferably less than 10 parts by mass, more preferably less than 5 parts by mass, still more preferably less than 1 part by mass, and yet still more preferably less than 0.01 parts by mass on a basis of the total amount of 100 parts by mass of the component (C) contained in the hydraulic fluid composition.

<Phosphorus-Based Anti-Wear Agent (D)>

From the viewpoint of more improving wear resistance, it is preferred that the hydraulic fluid composition of one embodiment of the present invention further contains the phosphorus-based anti-wear agent (D).

The phosphorus-based anti-wear agent (D) is preferably at least one selected from a phosphate and an amine salt of phosphate.

Examples of the phosphate include neutral phosphates, such as an aryl phosphate, an alkyl phosphate, an alkenyl phosphate, and alkylaryl phosphate; acidic phosphates, such as a monoaryl acid phosphate, a diaryl acid phosphate, a monoalkyl acid phosphate, a dialkyl acid phosphate, a monoalkenyl acid phosphate, and dialkenyl acid phosphate; phosphites, such as an aryl hydrogen phosphite, an alkyl hydrogen phosphite, an aryl phosphite, an alkyl phosphite, an alkenyl phosphite, and an arylalkyl phosphite; and acidic phosphites, such as a monoalkyl acid phosphite, a dialkyl acid phosphite, a monoalkenyl acid phosphite, and a dialkenyl acid phosphite.

These phosphates may be used alone or may be used in combination of two or more thereof.

The amine constituting the amine salt of phosphate is preferably a compound represented by the following general formula (d-i). The foregoing amine may be used alone or may be used in combination of two or more thereof.

$$(R^d)_q—N—(H)_{3-q} \quad \text{(d-i)}$$

In the general formula (d-i), q is an integer of 1 to 3, and preferably 1.

$R^d$'s are each independently an alkyl group having 6 to 18 carbon atoms, an alkenyl group having 6 to 18 carbon atoms, an aryl group having 6 to 18 ring carbon atoms, an arylalkyl group having 7 to 18 carbon atoms, or a hydroxyalkyl group having 6 to 18 carbon atoms, and preferably, an alkyl group having 6 to 18 carbon atoms.

In the case where there are a plurality of $R^d$'s, $R^d$'s may be the same as or different from each other.

In the hydraulic fluid composition of one embodiment of the present invention, from the viewpoint of more improving wear resistance, load bearing, and scoring resistance, the component (D) preferably includes a compound (D11) selected from an acidic phosphate (D11) and an amine salt of acidic phosphate (D12), and more preferably includes a neutral phosphate (D2) together with the compound (D1).

The acidic phosphate (D11) is preferably a compound represented by the following general formula (d1-1) or a compound represented by the following general formula (d1-2).

(d1-1)

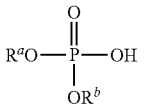

(d1-2)

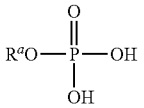

In the general formulae (d1-1) and (d1-2), $R^a$ and $R^b$ are each independently an alkyl group having 1 to 12 carbon atoms (3 to 10 carbon atoms, more preferably 3 to 8 carbon atoms, and still more preferably 3 to 6 carbon atoms).

$R^a$ and $R^b$ may be the same as or different from each other.

The amine salt of acidic phosphate (D12) is preferably an amine salt of the compound represented by the general formula (d1-1) or an amine salt of the compound represented by the general formula (d1-2).

The amine constituting the component (D12) is preferably the compound represented by the general formula (d-i).

The neutral phosphate (D2) is preferably a compound represented by the following general formula (d2-1), and more preferably a compound represented by the following general formula (d2-2).

(d2-1)

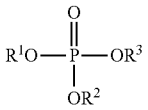

(d2-2)

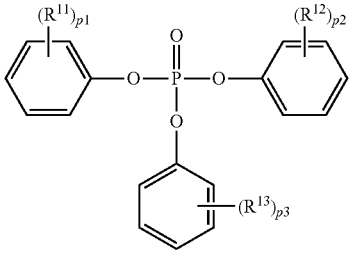

In the general formula (d2-1), $R^1$ to $R^3$ are each independently an alkyl group having 1 to 12 carbon atoms or an aryl group having 6 to 18 ring carbon atoms and being substituted with an alkyl group having 1 to 12 carbon atoms.

In the general formula (d2-2), $R^{11}$ to $R^{13}$ are each independently an alkyl group having 1 to 12 carbon atoms. p1 to p3 are each independently an integer of 1 to 5, preferably an integer of 1 to 2, and more preferably 1.

From the viewpoint of more improving wear resistance, load bearing, and scoring resistance, the compound (D1) is preferably the amine salt of acidic phosphate (D12).

For that reason, it is more preferred to contain the neutral phosphate (D2) together with the component (D12).

In the hydraulic fluid composition of one embodiment of the present invention, in the case where the component (D) includes both the component (D1) and the component (D2), from the viewpoint of more improving wear resistance, load bearing, and scoring resistance, a content ratio of the component (D1) to the component (D2) [(D1)/(D2)] is 0.001 to 2.000, more preferably 0.005 to 1.000, still more preferably 0.007 to 0.500, and yet still more preferably 0.010 to 0.100 in terms of a mass ratio.

In the hydraulic fluid composition of one embodiment of the present invention, the total content of the components (D1) and (D2) is preferably 70 to 100% by mass, more preferably 80 to 100% by mass, still more preferably 90 to 100% by mass, and yet still more preferably 95 to 100% by mass on a basis of the total amount (100% by mass) of the component (D) contained in the hydraulic fluid composition.

In the hydraulic fluid composition of one embodiment of the present invention, the content of the component (D) is preferably 0.1 to 2.0% by mass, more preferably 0.2 to 1.2% by mass, still more preferably 0.3 to 1.0% by mass, and yet still more preferably 0.5 to 0.9% by mass on a basis of the total amount (100% by mass) of the hydraulic fluid composition.

<Other Additive>

The hydraulic fluid composition of one embodiment of the present invention may contain other additive for hydraulic fluid not corresponding to the components (B) to (D) within a range where the effects of the present invention are not impaired.

Examples of the other additive for hydraulic fluid include a viscosity index improver, a flow point depressant, an extreme pressure agent, a rust inhibitor, a metal deactivator, a demulsifier, and an anti-foaming agent.

These additives for hydraulic fluid may be used either alone or in combination of two or more thereof.

Although the content of each of these additives for hydraulic fluid can be appropriately regulated within a range where the effects of the present invention are not impaired, it is typically 0.001 to 15% by mass, preferably 0.005 to 10% by mass, and more preferably 0.01 to 8% by mass on a basis of the total amount (100% by mass) of the hydraulic fluid composition.

In this specification, taking into consideration handling properties and solubility in the base oil (A), the additive, such as a viscosity index improver and an anti-foaming agent, may be blended in a form of a solution having been diluted with and dissolved in a part of the based oil (A), with other components.

In such a case, in this specification, the aforementioned content of the additive, such as an anti-foaming agent and a viscosity index improver, means the content as expressed in terms of the effective component excluding a diluent oil (expressed in terms of the resin content).

In the hydraulic fluid composition of one embodiment of the present invention, the content of the phosphorus atom is preferably 100 to 1,000 ppm by mass, more preferably 250 to 900 ppm by mass, still more preferably 350 to 800 ppm by mass, and yet still more preferably 450 to 750 ppm by mass on a basis of the total amount (100% by mass) of the hydraulic fluid composition.

In this specification, the content of the phosphorus atom means a value as measured in conformity with JPI-5S-38-03.

In the hydraulic fluid composition of one embodiment of the present invention, from the viewpoint of providing a hydraulic fluid composition having a high effect for suppressing the sludge formation when used for hydraulic equipment in which a working pressure is 30 MPa or more, it is preferred that the content of zinc dithiophosphate (ZnDTP) is as small as possible, and it is more preferred that the zinc dithiophosphate (ZnDTP) is not substantially contained.

Specifically, in the hydraulic fluid composition of one embodiment of the present invention, the content of the zinc atom is preferably less than 100 ppm by mass, more preferably less than 10 ppm by mass, still more preferably less than 5 ppm by mass, and yet still more preferably less than 1 ppm by mass on a basis of the total amount (100% by mass) of the hydraulic fluid composition.

In this specification, the content of the zinc atom means a value as measured in conformity with JPI-5S-38-03.

From the same viewpoint as mentioned above, it is preferred that the content of the sulfur atom-containing compound is as small as possible, and it is more preferred that the sulfur atom-containing compound is not substantially contained.

Specifically, in the hydraulic fluid composition of one embodiment of the present invention, the content of the sulfur atom is preferably less than 200 ppm by mass, more preferably less than 150 ppm by mass, and still more preferably less than 100 ppm by mass on a basis of the total amount (100% by mass) of the hydraulic fluid composition.

In this specification, the content of the sulfur atom means a value as measured in conformity with JIS K2541-6:2013.

[Various Properties of Hydraulic Fluid Composition]

A kinematic viscosity at 40° C. of the hydraulic fluid composition of one embodiment of the present invention is preferably 10 to 100 $mm^2/s$, more preferably 13 to 75 $mm^2/s$, and still more preferably 25 to 55 $mm^2/s$.

A viscosity index of the hydraulic fluid composition of one embodiment of the present invention is preferably 100 or more, more preferably 110 or more, and still more preferably 120 or more.

With respect to the hydraulic fluid composition of one embodiment of the present invention, the amount of sludge formed as measured under a condition described in the section of Examples as mentioned later in conformity with JCMAS P045 on the occasion of performing a high-pressure piston pump test for 500 hours is preferably less than 5.0 mg/100 mL, more preferably less than 3.0 mg/100 mL, still more preferably less than 2.0 mg/100 mL, yet still more preferably less than 1.0 mg/100 mL, and especially preferably less than 0.5 mg/100 mL.

In this specification, details of the high-pressure piston pump test and a measurement method of the amount of sludge are those described in the section of Examples as mentioned later.

With respect to the hydraulic fluid composition of one embodiment of the present invention, the wear amount of vanes and a cam ring as measured under a condition described in the section of Examples as mentioned later in conformity with ASTM D2882 on the occasion of driving a base pump (a product name: "V-104C", manufactured by Vickers) for 100 hours is preferably less than 30 mg, more preferably less than 25 mg, still more preferably less than 22 mg, and yet still more preferably less than 10 mg.

With respect to the hydraulic fluid composition of one embodiment of the present invention, the friction coefficient as measured in conformity with JASO-M314-88 is preferably 0.160 or less, more preferably 0.150 or less, still more preferably 0.140 or less, and yet still more preferably 0.120 or less.

The friction coefficient means a value as measured based on the method described in the section of Examples.

With respect to the hydraulic fluid composition of one embodiment of the present invention, a weld load (WL) as measured in conformity with ASTM D2783 is preferably 1,300 N or more, more preferably 1,500 N or more, and still more preferably 1,800 N or more.

The weld load (WL) means a value as measured based on the method described in the section of Examples.

[Application of Hydraulic Fluid Composition]

The hydraulic fluid composition of the present invention is not only excellent in wear resistance and an effect for suppressing the sludge formation but also excellent in a braking performance or a clutch performance in a construction machinery and so on, even when used under a high-pressure condition.

For that reason, the hydraulic fluid composition of the present invention can be suitably used for hydraulic equipment which is equipped with at least one of a wet type brake and a wet type clutch and which is selected from a construction machinery, a general industrial machinery, and a power generator, and in which a working pressure is 30 MPa or more.

Examples of the construction machinery include cranes, such as a mobile crane, a stationary crane, and a derrick; excavators, such as a hydraulic excavator, a compact excavator, and a wheel type hydraulic excavator; land grading machines, such as a bulldozer; loaders, such as a wheel loader; transporting machines, such as a rough terrain hauler; compacting machines, such as a vibratory roller; dismantling machines, such as a breaker; foundation work machines, such as a pile driver and an earth auger; concrete/asphalt machines, such as a concrete pump vehicle; an elevating work platform, a paving machine, a shielding machine, a boring machine, and a snow blower.

Examples of the general industrial machinery include a vehicle, a machine tool, a gear device, a transporting device, air-conditioning equipment, and mining equipment.

That is, the present invention can also provide the following hydraulic equipment and method of using a hydraulic fluid composition.

(1) Hydraulic equipment using a hydraulic fluid composition containing a base oil (A), an antioxidant (B) including an amine-based antioxidant (B1) and a phenol-based antioxidant (B2), and a succinimide-based compound (C) and satisfying the aforementioned requirement (I), wherein the hydraulic equipment is equipped with at least one of a wet type brake and a wet type clutch and is selected from a construction machinery, a general industrial machinery, and a power generator, in which a working pressure is 30 MPa or more:

(2) A method of using a hydraulic fluid composition containing a base oil (A) and an antioxidant (B) including an amine-based antioxidant (B1) and a phenol-based antioxidant (B2), the hydraulic fluid composition being used for hydraulic equipment which is equipped with at least one of a wet type brake and a wet type clutch and which is selected from a construction machinery, a general industrial machinery, and a power generator, and in which a working pressure is 30 MPa or more.

Preferred embodiments of the hydraulic fluid composition as prescribed in the above (1) and (2) are those as mentioned above.

EXAMPLES

Next, the present invention is described in more detail by reference to Examples, but it should be construed that the present invention is by no means limited by these Examples. Various properties of the respective components used in the Examples and Comparative Examples and the obtained hydraulic fluid compositions were measured in conformity with the following methods.

<Kinematic Viscosity and Viscosity Index>

Measured and calculated in conformity with JIS K2283: 2000.

<Content of Each of Phosphorus Atom and Zinc Atom>

Measured in conformity with JPI-5S-38-03.

<Content of Sulfur Atom>

Measured in conformity with JIS K2541-6:2013.

<Content of Nitrogen Atom>

Measured in conformity with JIS K2609.

Examples 1 to 2 and Comparative Examples 1 to 2

The following base oil and various additives were added in blending amounts shown in Table 1 and thoroughly mixed to prepare hydraulic fluid compositions, respectively.

Details of the mineral oil and various additives used in the Examples and Comparative Examples are as follows.

<Base Oil>

"100N mineral oil": Mineral oil grouped in Group III by the API category, kinematic viscosity at 40° C.=20.44 $mm^2/s$, viscosity index=122, % $C_P$=73.5, % $C_N$=26.5, % $C_A$=0.0

"150N mineral oil": Mineral oil grouped in Group II by the API category, kinematic viscosity at 40° C.=30.60 $mm^2/s$, viscosity index=104, % $C_P$=67.1, % $C_N$=32.9, % $C_A$=0.0

"500N mineral oil": Mineral oil grouped in Group II by the API category, kinematic viscosity at 40° C.=90.51 $mm^2/s$, viscosity index=107, % $C_P$=72.0, % $C_N$=28.0, % $C_A$=0.0

<Antioxidant>

"Amine-based antioxidant": Alkylated diphenylamine

"Phenol-based antioxidant": 2,6-Di-t-butyl-4-methylphenol

<Ashless Friction Modifier>

"Succinimide": Polybutenyl succinic acid bisimide having a polybutenyl group having a number average molecular weight (Mn) of 1,000, content of nitrogen atom=1.15% by mass <Anti-Wear Agent>

"Acidic phosphate amine salt"

"Neutral phosphate": Tricresyl phosphate

"ZnDTP": Zinc dithiophosphate

<Other Additives>

"Rust inhibitor": Sorbitan monooleate

"Metal deactivator": Benzotriazole

"Viscosity index improver": Polymethacrylate having a weight average molecular weight of 37,000

"Flow point depressant": Polymethacrylate having a weight average molecular weight of 69,000

"Anti-foaming agent": Silicone-based anti-foaming agent

With respect to the hydraulic fluid compositions prepared in the Examples and comparative Examples, the kinematic viscosity at 40° C. and the viscosity index as well as the contents of a phosphorus atom, a sulfur atom, and a zinc atom were measured and shown in Table 1.

In addition, the hydraulic fluid compositions prepared in the Examples and comparative Examples were used as sample oils and subjected to the following measurements. These measurement results are also shown in Table 1.

(1) Static Friction Coefficient ($\mu_s$)

A static friction coefficient ($\mu_s$) after 1,000 cycles was measured in conformity with the SAE No. 2 test described in JCMAS P 047:2004.

(2) High-Pressure Piston Pump Test

In conformity with JCMAS P045, the sample oil was introduced into a hydraulic circuit of a high-pressure piston pump test apparatus (pump: BOSCH-REXROTH A2F10) and subjected to the high-pressure piston pump test under a condition of a pump pressure of 35.0 MPa, a sample oil temperature of 80° C., and an air blowing amount of 1.0 L/h for 500 hours.

Then, the amount of sludge formed after the test (unit: mg/100 mL) was measured in conformity with JIS B9931.

(3) Wear Test of Pump

Using a vane pump (a product name: "V-104C", manufactured by Vickers), on the occasion of driving for 100 hours in conformity with ASTM D2882 under a condition of a pump pressure of 13.8 MPa, an oil temperature of 66° C., a rotational speed of 1,200 rpm, a sample oil amount of 60 L, and a flow rate of 25 L/min, the wear amount (unit: mg) of vanes and a cam ring was measured.

(4) Soda-Type Pendulum Test

The friction coefficient was measured in conformity with the "Soda-type pendulum test" prescribed in JASO-M314-88 using a Soda-type pendulum tester (Model II) at an oil temperature of 60° C.

(5) Shell Four-Ball EP Test

The weld load (WL) was measured with a four-ball tester in conformity with ASTM D2783 under a condition of a rotational speed of 1,800 rpm and a temperature of 25° C. It may be said that the larger the value of the weld load (WL), the more excellent the load bearing is.

(6) FZG Scoring Test

In conformity with ASTM D5182-97, a load was increased by stages along the prescriptions under a condition of a sample oil temperature of 90° C., a rotational speed of 1,450 rpm, and an operation time of 15 minutes using an A-type gear, and a stage of load on the occasion of generation of the scoring was determined. It may be said that the higher the value of the stage, the more excellent the scoring resistance is.

TABLE 1

| | | | | Example 1 | Example 2 | Comparative Example 1 | Comparative Example 2 |
|---|---|---|---|---|---|---|---|
| Composition | Base oil | 100N mineral oil | mass % | — | 40.15 | — | — |
| | | 150N mineral oil | mass % | 63.57 | — | 63.68 | 64.95 |
| | | 500N mineral oil | mass % | 31.92 | 56.43 | 31.91 | 33.85 |
| | Antioxidant | Amine-based antioxidant | mass % | 0.20 | 0.20 | 0.20 | — |
| | | Phenol-based antioxidant | mass % | 0.60 | 0.60 | 0.60 | — |
| | Ashless friction modifier | Succinimide | mass % | 0.10 | 0.10 | — | — |
| | Anti-wear agent | Acidic phosphate amine salt | mass % | 0.01 | — | 0.01 | — |
| | | Neutral phosphate | mass % | 0.88 | 0.80 | 0.88 | — |
| | | ZnDTP | mass % | — | — | — | 0.70 |
| | Other additive | Rust inhibitor | mass % | 0.10 | 0.10 | 0.10 | — |
| | | Metal deactivator | mass % | 0.02 | 0.02 | 0.02 | — |
| | | Viscosity index improver | mass % | 2.00 | 0.50 | 2.00 | — |
| | | Flow point depressant | mass % | 0.50 | 1.00 | 0.50 | 0.50 |
| | | Anti-foaming agent | mass % | 0.10 | 0.10 | 0.10 | — |
| | Total | | mass % | 100.00 | 100.00 | 100.00 | 100.00 |
| Various properties | Kinematic viscosity at 40° C. | | mm2/s | 48.30 | 48.24 | 48.05 | 46.19 |
| | Viscosity index | | | 121 | 127 | 122 | 108 |
| | Phosphorus atom content | | mass ppm | 623 | 658 | 665 | 403 |
| | Sulfur atom content | | mass ppm | 100> | 100> | 100> | 857 |
| | Zinc atom content | | mass ppm | 1> | 1> | 1> | 492 |
| | (1) Static friction coefficient ($\mu_s$) | | — | 0.117 | 0.111 | 0.163 | 0.175 |
| | (2) High-pressure piston pump test: Sludge amount | | mg/100 mL | 0.4 | 1.6 | 6.3 | 22.0 |
| | (3) Wear test of pump: Wear amount | | mg | 7.0 | 21.3 | 13.0 | 48.0 |
| | (4) Soda-type pendulum test: Friction coefficient | | — | 0.116 | 0.144 | 0.118 | 0.187 |
| | (5) Shell four-ball EP test: Weld load (WL) | | N | 1961 | 1569 | 1569 | 1236 |
| | (6) FZG scoring test | | — | 10 fail | 8-9 fail | 10 fail | 10 fail |

As for the hydraulic fluid compositions prepared in Examples 1 to 2, the static friction coefficient ($\mu_s$) falls within an appropriate range, so that it may be considered that they are also excellent in the braking performance and the clutch performance. In addition, there were brought the results such that even when used under a high-pressure condition as 30 MPa, not only the effect for suppressing the sludge formation is excellent, but also the wear resistance is favorable.

On the other hand, as for the hydraulic fluid compositions prepared in Comparative Examples 1 to 2, the static friction coefficient ($\mu_s$) is high, so that there is a concern about worsening of the braking properties, and there were brought the results such that early wear deterioration of a wet clutch is possibly caused.

The invention claimed is:

1. A hydraulic fluid composition, consisting of:

a base oil (A), an antioxidant (B) comprising an amine-based antioxidant (B1) and a phenol-based antioxidant (B2), a succinimide-based compound (C), a viscosity index improver consisting of a polymethacrylate having a weight average molecular weight of 37,000, a flow point depressant consisting of a polymethacrylate having a weight average molecular weight of 69,000, and optionally, one or more other additives selected from the group consisting of an extreme pressure agent, a phosphorus-based anti-wear agent, a rust inhibitor, a metal deactivator, a demulsifier, and an anti-foaming agent, wherein the content of the viscosity index improver is 0.50 to 2.00% by mass, wherein the content of the flow point depressant is 0.50 to 1.00% by mass, and wherein the hydraulic fluid composition: satisfies the following requirement (I); and is suitable for hydraulic equipment which is equipped with at least one of a wet type brake and a wet type clutch, which is selected from construction machinery, general industrial machinery, and a power generator, and in which a working pressure is 30 MPa or more:

(I): a static friction coefficient ($\mu_s$) after 1,000 cycles, as measured in conformity with the SAE No. 2 test described in JCMAS P 047:2004, is from 0.100 to 0.162; and, wherein the hydraulic fluid composition has a viscosity index of from 100 to 127.

2. The hydraulic fluid composition of claim 1, wherein a content of zinc is less than 100 ppm by mass, based on a total amount of the hydraulic fluid composition.

3. The hydraulic fluid composition of claim 1, wherein a content proportion of the succinimide-based compound (C) is from 1.0 to 20.0 parts by mass, based on a total amount of 100 parts by mass of the amine-based antioxidant (B1) and the phenol-based antioxidant (B2).

4. The hydraulic fluid composition of claim 1, wherein a content ratio of the amine-based antioxidant (B1) to the phenol-based antioxidant (B2) [(B1)/B2)] is 1/6 or more and less than 1/2 in terms of a mass ratio.

5. The hydraulic fluid composition of claim 1, wherein a content of the amine-based antioxidant (B1) is from 0.01 to 1.0% by mass, based on a total amount of the hydraulic fluid composition.

6. The hydraulic fluid composition of claim 1, wherein a content of the phenol-based antioxidant (B2) is from 0.025 to 6.0% by mass, based on a total amount of the hydraulic fluid composition.

7. The hydraulic fluid composition of claim 1, wherein a content of the succinimide-based compound (C) is from 0.01 to 1.0% by mass, based on a total amount of the hydraulic fluid composition.

8. The hydraulic fluid composition of claim 1, wherein the hydraulic fluid composition further contains the phosphorus-based anti-wear agent (D).

9. The hydraulic fluid composition of claim 8, wherein the phosphorus-based anti-wear agent (D) is a compound (D1) selected from an acidic phosphate (D11) and an amine salt of acidic phosphate (D12).

10. The hydraulic fluid composition of claim 1, wherein a content of the phenol-based antioxidant (B2) is from more than 0.50 to 6.0% by mass, based on a total amount of the hydraulic fluid composition.

11. The hydraulic fluid composition of claim 1, wherein the static friction coefficient is from 0.105 to 0.158.

12. The hydraulic fluid composition of claim 1, wherein the base oil (A) is at least one selected from a Group 2 mineral oil and a Group 3 mineral oil, the amine-based antioxidant (B1) is at least one selected from a diphenylamine-based compound and a naphthylamine-based compound, the phenol-based antioxidant (B2) is at least one selected from a monophenol-based antioxidant, a diphenol-based antioxidant and a hindered phenol-based antioxidant, the succinimide-based compound (C) is at least one selected from an alkenylsuccinimide (C1) and a boronated alkenylsuccinimide (C2), and the hydraulic fluid composition contains the phosphorus-based anti-wear agent (D) which is at least one selected from a phosphate and an amine salt of a phosphate.

13. The hydraulic fluid composition of claim 12, wherein the base oil (A) is the Group 2 mineral oil or the Group 2 mineral oil and the Group 3 mineral oil, the amine-based antioxidant (B1) is the diphenylamine-based compound, the phenol-based antioxidant (B2) is the monophenol-based antioxidant, the succinimide-based compound (C) is the alkenylsuccinimide (C1), and the phosphorus-based anti-wear agent (D) is the neutral phosphate or the neutral phosphate and the amine salt of the phosphate.

14. The hydraulic fluid composition of claim 13, wherein, based on a total amount of the hydraulic fluid composition:

a content of the base oil (A) is from 75 to 98% by mass, a content of the amine-based antioxidant (B1) is from 0.19 to 0.45% by mass, a content of the phenol-based antioxidant (B2) is from 0.40 to 2.0% by mass, a content of the succinimide-based compound (C) is from 0.10 to 0.60% by mass, and a content of the phosphorus-based anti-wear agent (D) is from 0.5 to 0.9% by mass.

* * * * *